US005256932A

United States Patent [19]

Watanabe et al.

[11] Patent Number: 5,256,932

[45] Date of Patent: Oct. 26, 1993

[54] COLOR CATHODE RAY TUBE

[75] Inventors: Tetsuya Watanabe; Morio Yamamoto, both of Nagaokakyo; Tohru Hanada, Amagasaki; Hiroshi Kimura, Amagasaki; Masayasu Koitabashi, Amagasaki, all of Japan

[73] Assignee: Mitsubishi Denki Kabushiki Kaisha, Tokyo, Japan

[21] Appl. No.: 536,767

[22] Filed: Jun. 12, 1990

[30] Foreign Application Priority Data

Jun. 15, 1989 [JP] Japan ..... 1-154914

[51] Int. Cl.[5] ..... H01J 29/07

[52] U.S. Cl. ..... 313/402; 313/355

[58] Field of Search ..... 313/402, 355

[56] References Cited

U.S. PATENT DOCUMENTS

| | | | |
|---|---|---|---|
| 3,604,970 | 9/1971 | Culbertson et al. | 313/355 |
| 4,442,376 | 4/1984 | Van Der Waal et al. | 313/402 |
| 4,692,659 | 9/1987 | Takenaka et al. | 313/402 |
| 4,734,615 | 3/1988 | Koike et al. | 313/402 |
| 4,810,927 | 3/1989 | Watanabe | 313/402 |
| 4,884,004 | 11/1989 | Deal et al. | 313/402 |

FOREIGN PATENT DOCUMENTS

| | | |
|---|---|---|
| 55-76553 | 6/1980 | Japan . |
| 57-50745 | 3/1982 | Japan . |
| 61-6969 | 3/1986 | Japan . |
| 62-274525 | 11/1987 | Japan . |

OTHER PUBLICATIONS

"Reduction of Doming Effect in CRT Shadow Mask by the Electron Reflective Coatings" by Koitabashi et al, Feb. 9, 1989.

German article entitled, "Werkstoffkunde fur die Elektrotechnik und Elektronik" by Dr. phil. Lothar Hahn; Chem.-Ing. Irene Munke u.a.; Veb Verlag Technik Berlin; 4., unveranderte Auflage; p. 465; 1986.

*Primary Examiner*—Donald J. Yusko
*Assistant Examiner*—Michael Horabik

[57] ABSTRACT

A color cathode ray tube includes an electron gun, a fluorescent screen which emits light when contacted by electron beams emitted from the electron gun, and a shadow mask arranged between the electron gun and the fluorescent screen and having a plurality of through holes for the electron beams. The color cathode ray tube further includes an electron beam reflecting film formed on an electron beam irradiated surface of the shadow mask using tungsten powder, to which at least a metal, that is not more likely to be oxidized than tungsten, is added or coated.

3 Claims, 5 Drawing Sheets

COLOR CATHODE RAY TUBE

FIELD OF THE INVENTION

The present invention relates to a color cathode ray tube and, more particularly, to a technique for preventing a doming effect in which a shadow mask deforms because a temperature of the shadow mask is increased by thermal energy generated by collision of an electron beam emitted from an electron gun, causing color dislocation in a picture.

BACKGROUND OF THE INVENTION

A conventional color cathode ray tube is disclosed in, for example Japanese Patent Laid Open Gazette No. 55-76553, in which an electron beam reflecting film comprising bismuth oxide ($Bi_2O_3$) as a main element and binder such as water glass is mixed therein is formed on an electron beam irradiated surface of a shadow mask.

According to the above shadow mask, when an electron beam with high energy is irradiated on the surface of the shadow mask, doming, caused by an increase of a temperature of the shadow mask, can be prevented by increasing the ratio of the number of electrons elastically or inelastically scattered backward to the number of irradiated electrons, that is, the backward scattering coefficient. Thus, almost 30% of the irradiated electron beam energy is scattered backward.

In addition, such doming preventing technique is reported in detail in Japan Society of Electronics, Information, and Communication Engineers, "Doming prevention of CRT shadow mask by electron beam reflecting film", published on Feb. 9, 1989.

According to the conventional color cathode ray tube, an anti-doming effect obtained by the electron reflecting film formed on the shadow mask is approximately 30%, which is not sufficient for a large sized color cathode ray tube.

In addition, it has been conventionally proposed that a film comprising metal tungsten as a main element is formed on a surface of the shadow mask instead of the film comprising $Bi_2O_3$ as a main element. When the film comprising metal tungsten as a main element is used, the anti-doming effect can be 50% in theory. As a result of ardent study by the inventors of the present invention over a long period of time it has been found that performance of the film can be improved by 50% or more, as compared with that of the film comprising $Bi_2O_3$ as a main element.

However, in case of the film comprising metal tungsten as a main element, since manufacturing process in which the film is baked is usually used, oxidation occurs the tungsten powder. As a result, the substantial anti-doming effect by the tungsten film is approximately 35%, which is almost the same as that of the conventional film comprising $Bi_2O_3$ as a main element.

SUMMARY OF THE INVENTION

The present invention was made in order to solve the above problems and it is an object of the present invention to provide a color cathode ray tube in which oxidation of tungsten powder is prevented, even if the film is baked, in the air and sufficiently high anti-doming effect can be attained.

Other objects and advantages of the present invention will become apparent from the detailed description given hereinafter; it should be understood, however, that the detailed description and specific embodiment are given by way of illustration only, since various changes and modifications within the spirit and scope of the invention will become apparent to those skilled in the art from this detailed description.

According to a color cathode ray tube in accordance with the present invention, an electron beam reflecting film is formed on an electron beam irradiated surface of a shadow mask using tungsten powder to which at least one kind of metal selected from a group of group 1B elements (such as Cu, Ag and Au as listed on the periodic table), platinum group element, bismuth, lead or nickel is added or coated.

In addition, according to another color cathode ray tube of the present invention, an electron beam reflecting film is formed on an electron beam irradiated surface of the shadow mask using tungsten powder to which at least one kind of metal selected from a group consisting of magnesium, aluminum, group, silicon, vanadium, manganese or molybdenum added or coated.

According to an aspect of the present invention, oxidation of tungsten powder generated in the manufacturing process in which the film is baked in the air is prevented by adding or coating metal, which is less likely to be oxidized than tungsten, tungsten powder, so that the anti-doming effect by the film comprising tungsten as a main element can be improved.

Furthermore, according to another aspect of the present invention, a stable oxide layer is promptly formed on a surface of tungsten powder in the manufacturing process in which the film is baked in the air by adding or coating metal, which is more likely to be oxidized than tungsten, tungsten powder, so that thermal oxidation of tungsten powder itself can be prevented and the anti-doming effect by the film can be improved.

DETAILED DESCRIPTION OF THE PREFERRED EMBODIMENTS

An embodiment of the present invention will be described in detail with reference to the drawings.

Figure 1:
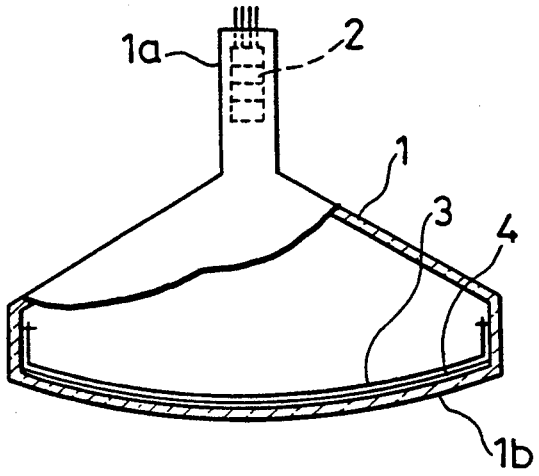
FIG. 1 is a partially broken side view showing a color cathode ray tube in accordance with an embodiment of the present invention.

FIG. 1 is a partially broken side view showing a color cathode ray tube in accordance with an embodiment of the present invention. In FIG. 1, reference numeral 1 designates an outer frame for keeping its inside highly vacuous. Reference numeral 2 designates an electron gun built in a neck part 1*a* of the outer frame, which emits an electron beam toward a translucent glass panel part 1*b* serving as a part of the outer frame 1.

Figure 2:
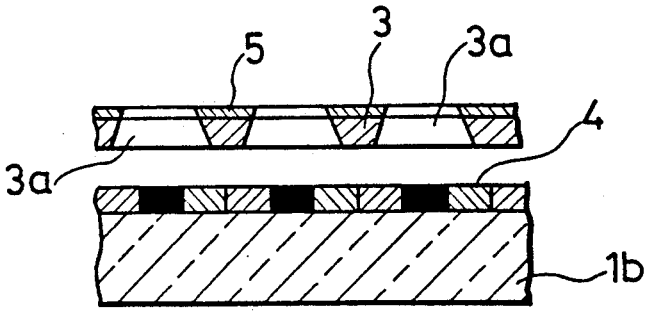
FIG. 2 is an enlarged sectional view showing a main part.

Reference numeral 3 designates a shadow mask formed of a thin iron plate, in which a number of through holes 3*a* for electron beams are formed as shown in FIG. 2. Reference numeral 4 designates a fluorescent screen on which three kinds of stripes of fluorescent materials emitting red, green and blue light are applied to an inner surface of the glass panel 1*b*. These stripes of the fluorescent materials are arranged so as to each correspond to each of the electron beam through holes 3*a* in the shadow mask 3 in an electronic optical manner.

According to the color cathode ray tube with above construction, an electron beam reflecting film 5, comprising tungsten, having large reflection coefficient to the electron beam, as a main component, is formed on the side of the electron beam irradiated surface of the shadow mask 3 as shown in FIG. 2.

The electron beam reflecting film 5 is formed of tungsten powder to which one or more kinds of metals selected from a group of group 1*b* element (such as Cu, Ag, or Au as listed on the periodic table), platinum group element, bismuth, lead, or nickel, which is not likely to be oxidized as compared with tungsten, are applied or coated by 50 to 10000 ppm.

Alternatively, the film may be formed of tungsten powder to which one or more kinds of metals selected from a group of magnesium, aluminum, silicon, vanadium, or molybdenum are applied or coated by 50 to 10000 PPM.

Next, operation thereof will be described hereinafter.

Three electron beams emitted from the electron gun 2 are deflected so as to scan the whole surface of the fluorescent screen 4 by a deflecting apparatus (not shown) and then reach the shadow mask 3. The three electron beams pass through the electron beam through holes 3*a* of the shadow mask 3 and hit the stripes of the fluorescent materials on the fluorescent screen 4 to make them emit light, with the result that a color picture is projected on the fluorescent screen 4.

Most of the electron beams which hit the shadow mask 3 are scattered toward the electron gun 2, that is, backward by the electron beam reflecting film 5, whereby thermal energy to be applied to the shadow mask 3 by the electron beams is reduced. Then it is possible to prevent color dislocation in the picture caused by thermal deformation of the shadow mask 3.

Hereinafter, a description will be given of doming examples and their results performed by the inventors by using the electron beam reflecting film 5 comprising tungsten as a main element and a metal applied thereto. The kind of the above metal is different in each example.

EXAMPLE 1

Tungsten powder to which silver is coated through chemical treatment (silver concentration is 6000 ppm) was sprayed on the shadow mask until its thickness became 10 microns and then baked at a temperature of 450 C for 30 minutes in the air. The thus formed film was subjected to X-ray diffraction.

Figure 3:
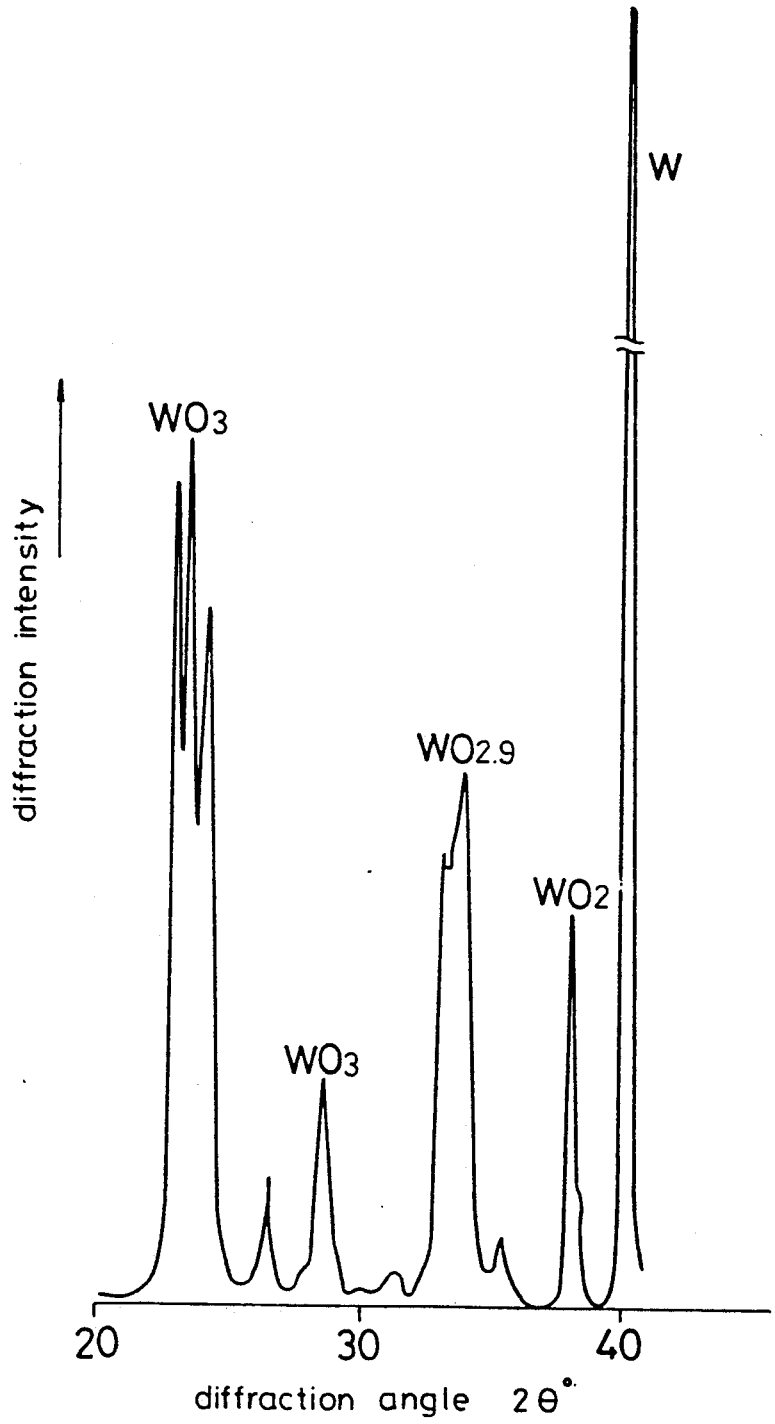
FIG. 3 is a graph showing a result of X-ray diffraction of a film formed in accordance with an example 1.

As a result, as shown in FIG. 3, a material ($WO_3$) produced by oxidation is confirmed by a diffraction peak around a diffraction angle of 23.28 degrees, a product material ($WO_{2.9}$) is confirmed by a diffraction peak around that of 33 degrees and that of 37 degrees. Here, a diffraction peak of metal tungsten (W) was around a diffraction angle of 40 degrees.

As can be seen from the result shown in FIG. 3, since metal tungsten sufficiently remained in the above tungsten powder, it was found that an amount of oxide ($WO_3$) was less than that of tungsten (W).

Figure 4:
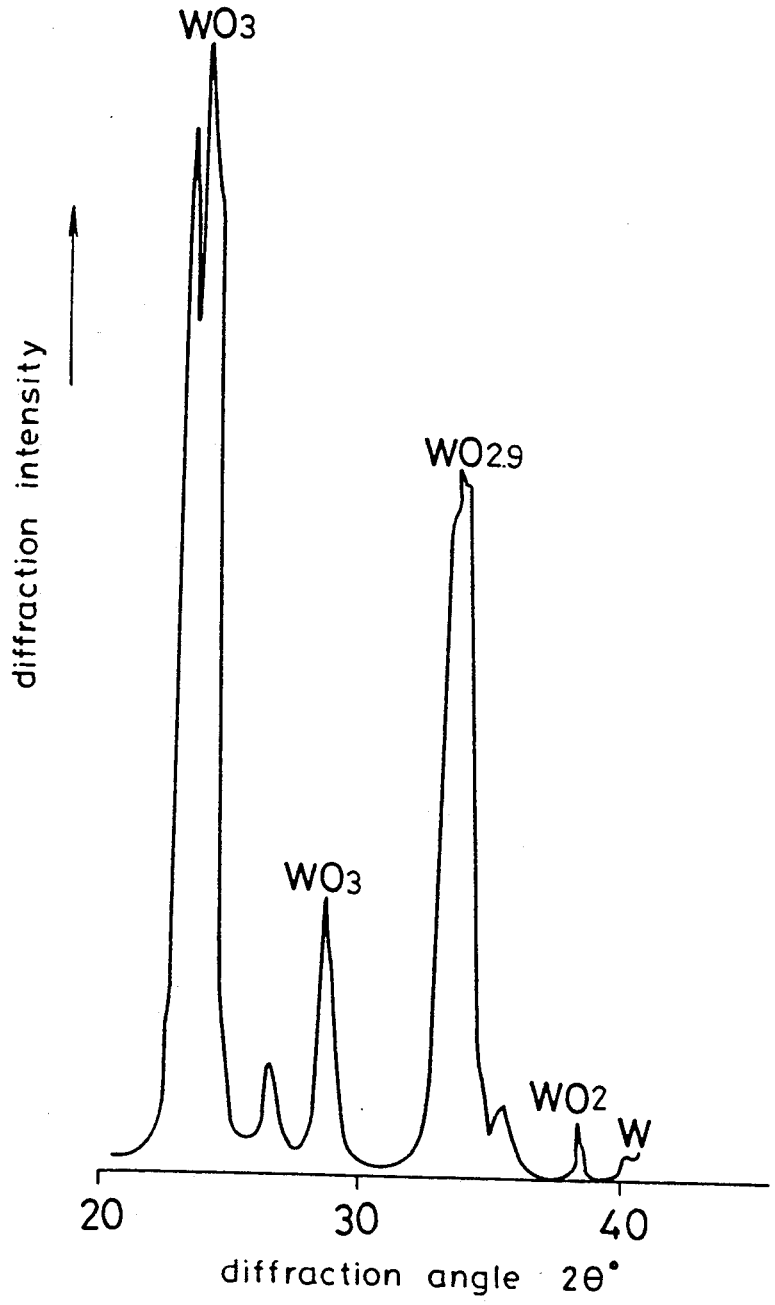
FIG. 4 is a graph showing a result of X-ray diffraction of a film formed in accordance with an example 2.

In addition, a result of X-ray diffraction of the film formed on pure tungsten powder which was baked in the same condition as above is shown in FIG. 4 for comparison. When the film was formed of pure tungsten powder, it was clear that metal tungsten (W) almost disappeared and an amount of oxide ($WO_3$) was overwhelmingly great.

Then, the shadow mask on which the film was formed of tungsten powder coated in silver as described above was built in a 25-inch color CRT and then an anti-doming effect was measured. As a result, it was found that the anti-doming effect was 50%.

EXAMPLE 2

A film with a thickness of 7 microns was formed on a shadow mask surface using tungsten powder alloyed by adding palladium (Pd) to tungsten by 500 ppm and then it was baked in the air. Then, this shadow mask was built in a 29-inch color CRT and then an anti-coming effect was measured. As a result, it was found that the anti-doming effect was 49%.

EXAMPLE 3

Figure 5:
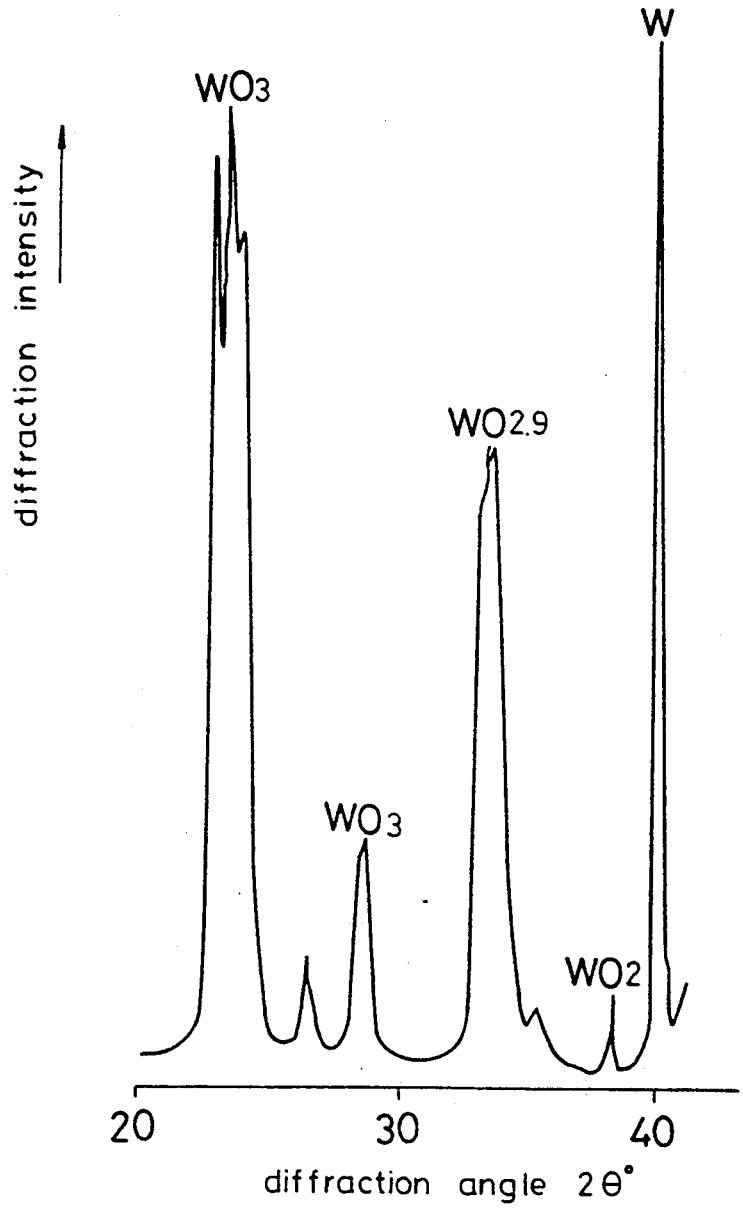
FIG. 5 is a graph showing a result of X-ray diffraction of a film formed in accordance with an example 3.

FIG. 5 shows a result of X-ray diffraction of a film with a thickness of 10 microns which was formed using tungsten powder alloyed by adding molybdenum (Mo) to tungsten by 100 ppm and it was baked in the same condition as in the example 1. As can be seen from FIG. 5, it was found that metal tungsten also sufficiently remained in this example 3 and the ratio of it was almost equal to that of produced oxide ($WO_3$). More specifically, it was found that molybdenum (Mo) had practically enough anti-oxidation effect, even if concentration of molybdenum was not so high.

The shadow mask in accordance with the example 3 was built in a 25-inch color CRT and then the anti-doming effect was measured. As a result, it was found that the anti-doming effect was 48%.

EXAMPLE 4

A film with a thickness of 15 microns was formed on a shadow mask surface using tungsten powder coated by aluminum (Al) in concentration of 10000 ppm and then it was baked in the air. Then, this was built in the 29-inch color CRT and then the anti-doming effect was measured. As a result, it was found that the anti-doming effect was 48%.

Figure 6:
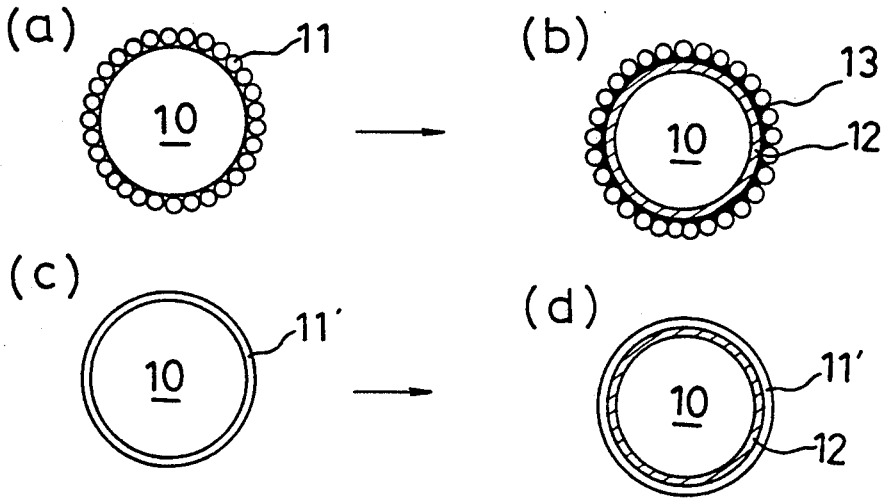
FIG. 6 is a schematic view showing the state where tungsten is coated with metal which is less likely to be oxidized than tungsten.

FIG. 6 is a schematic view showing the state where tungsten in the above described examples 1 and 2 is coated with metal which is less likely to be oxidized than tungsten. In this figure, figure(a) shows the state where fine-grain silver 11 is coated to tungsten 10; figure (c) shows the state where uniform coating layer is formed on the surface of tungsten 10 using fine-grain silver 11′ whose grains are smaller than those of silver 11; and figures(b) and (d) show the state of tungsten of figure (a) and (c) after baking, respectively. In figure(b), because the silver grain has little spaces from each other at the time of baking, the surface of tungsten 10 is slightly oxidized and becomes tungsten oxide layer 12. Adhesion between silver grains 13 is seen on the coating layer of silver 11. Furthermore, in figure(d), the surface of tungsten 10 is slightly oxidized.

Figure 7:
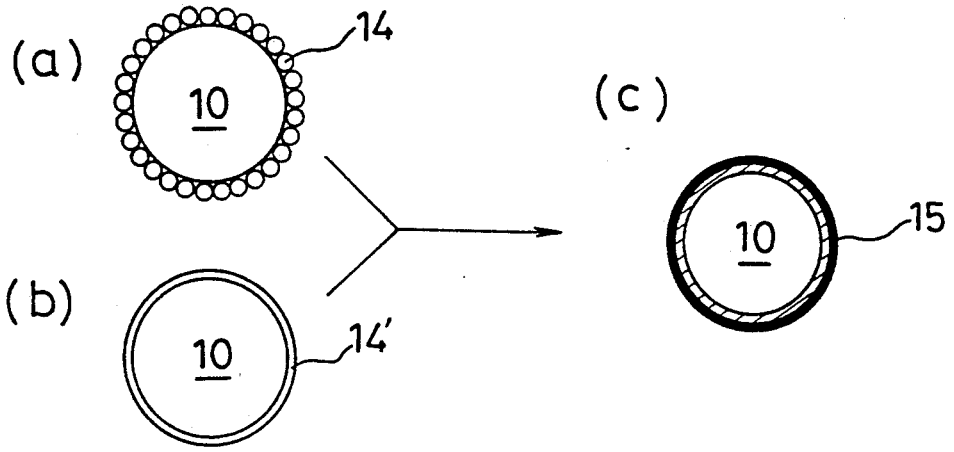
FIG. 7 is a schematic view showing the state where tungsten is coated with metal which is more likely to be oxidized than tungsten.

FIG. 7 is a schematic view showing the state where tungsten in the above described examples 3 and 4 is coated with metal which is more likely to be oxidized than tungsten. In this figure, figures(a) and (b) show the state where tungsten 10 is coated with aluminum either in the form of particles or uniformly (respectively 14, 14') in the same way as above described embodiment, and figure (c) shows the state of tungsten of figure (a) and (b) after baking. In both cases the surface of tungsten 10 is a little oxidized and aluminum 14 and 14' become alumina, $Al_2O_3$ 15.

As described above, according to an aspect of the present invention, oxidation of tungsten can be prevented only by adding a small amount of metal, which is not likely to be oxidized as compared with tungsten, to tungsten which is likely to be oxidized, even when normal manufacturing process in which a film is baked in the air is used. As a result, the anti-doming effect can be fairly improved, while manufacturing costs are almost the same as when a film is formed of $Bi_2O_3$ in a conventional manner.

Furthermore, according to another aspect of the present invention, a stable oxide layer can be promptly formed on a surface of tungsten powder by adding metal which is likely to be oxidized as compared with tungsten, so that thermal oxidation of tungsten powder itself can be prevented. As a result, the anti-doming effect of the film comprising tungsten as a main element can be fairly improved.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A color cathode ray tube comprising:

an electron gun;

a fluorescent screen which emits light when contacted by electron beams emitted from said electron gun;

a shadow mask arranged between said electron gun and said fluorescent screen, having a plurality of through holes through which said emitted electron beams travel; and an electron beam reflecting film formed on an electron beam irradiated surface of said shadow mask, the electron beam reflecting film including tungsten powder to which at least a metal, that is less likely to be oxidized than tungsten, is added or coated.

2. A color cathode ray tube as defined in claim 1 wherein said metal, less likely to oxidized than tungsten, is selected from the group consisting of a group 1B element, a platinum group element, bismuth, and lead, either singly or in combination.

3. A color cathode ray tube comprising:

an electron gun;

a fluorescent screen which emits light when contacted by electron beams emitted from said electron gum;

a shadow mask arranged between said electron gun and said fluorescent screen, having a plurality of through holes through which said emitted electron beams travel; and an electron beam reflecting film formed on an electron beam irradiated surface of said shadow mask, the electron beam reflecting film including tungsten powder to which at least a metal, that is more likely to be oxidized than tungsten, is added or coated;

said metal, more likely to be oxidized than tungsten, is selected from a group consisting of magnesium, aluminum, silicon, vanadium, manganese, and molybdenum, either singly or in combination.

* * * * *